US011434030B2

(12) United States Patent
Meng

(10) Patent No.: US 11,434,030 B2
(45) Date of Patent: Sep. 6, 2022

(54) SEPARATING DEVICE FOR A STRAP END CONNECTING DEVICE, STRAP END CONNECTING DEVICE, AND STRAPPING SYSTEM

(71) Applicant: SIGNODE INDUSTRIAL GROUP LLC, Glenview, IL (US)

(72) Inventor: Michael Meng, Gipf-Oberfrick (CH)

(73) Assignee: Signode Industrial Group LLC, Tampa, FL (US)

( * ) Notice: Subject to any disclaimer, the term of this patent is extended or adjusted under 35 U.S.C. 154(b) by 98 days.

(21) Appl. No.: 16/661,390

(22) Filed: Oct. 23, 2019

(65) Prior Publication Data

US 2020/0055621 A1 Feb. 20, 2020

Related U.S. Application Data

(63) Continuation of application No. PCT/US2018/030367, filed on May 1, 2018.

(30) Foreign Application Priority Data

May 3, 2017 (CH) ..... CH00590/17

(51) Int. Cl.
*B65B 13/32* (2006.01)

(52) U.S. Cl.
CPC ..... *B65B 13/32* (2013.01)

(58) Field of Classification Search
CPC ..... B65B 13/32; B65B 13/322; B65B 13/325; B65B 13/327; Y10T 156/1313
See application file for complete search history.

(56) References Cited

U.S. PATENT DOCUMENTS 2,837,883 A * 6/1958 Bracey ..... B29C 65/7433 53/552
3,316,687 A 5/1967 Bartlett
(Continued)

FOREIGN PATENT DOCUMENTS

CN 1764568 A 4/2006
CN 206107639 U 4/2017
(Continued)

OTHER PUBLICATIONS

Machine translation of Office Action issued by CNIPA in connection with CN 201880027181.3 and dated Nov. 4, 2020.
(Continued)

*Primary Examiner* — Anna K Kinsaul
*Assistant Examiner* — Himchan Song
(74) *Attorney, Agent, or Firm* — Neal, Gerber & Eisenberg LLP

(57) ABSTRACT

The present disclosure relates to a separating device for severing at least one strap, in particular a plastic strap, the separating device having a blade with an edge for severing the at least one strap, and it being possible for the separating device to be connected to a strap end connecting device, the strap end connecting device having an assembly which has a heating element, it being possible for the blade to be connected to that assembly of the strap end connecting device which has the heating element. In addition, the present disclosure relates to a strap end connecting device for a strapping system having a separating device of this type. In addition, the present disclosure relates to a strap end connecting device for a strapping system having a strap end connecting device of this type.

9 Claims, 9 Drawing Sheets

(56) References Cited

U.S. PATENT DOCUMENTS

| | | | | |
|---|---|---|---|---|
| 3,940,305 | A * | 2/1976 | Stenberg | B29C 66/81419 156/515 |
| 4,209,958 | A * | 7/1980 | Bailey | B65B 27/08 53/228 |
| 4,512,138 | A * | 4/1985 | Greenawalt | B29C 65/02 219/243 |
| 5,226,461 | A | 7/1993 | Macartney et al. | |
| 6,021,711 | A | 2/2000 | van Ottele | |

FOREIGN PATENT DOCUMENTS

| | | | |
|---|---|---|---|
| DE | 4401508 | A1 | 5/1995 |
| DE | 10225751 | A1 | 1/2004 |
| EP | 0225665 | A1 | 6/1987 |
| EP | 1448442 | B1 | 8/2006 |
| EP | 1578667 | B1 | 7/2008 |
| GB | 1502822 | A | 3/1978 |
| JP | H05246404 | A | 1/1993 |
| JP | H11278433 | A | 10/1999 |

OTHER PUBLICATIONS

"International Search Report and Written Opinion", PCT/US2018/030367 (14 pages), dated Sep. 6, 2018.

"Communication pursuant to Rule 164(2)(b) and Article 94(3) EPC", in corresponding European Patent Application No. 18726616.8, dated Feb. 2, 2022.

* cited by examiner

SEPARATING DEVICE FOR A STRAP END CONNECTING DEVICE, STRAP END CONNECTING DEVICE, AND STRAPPING SYSTEM

PRIORITY CLAIM

This application is a continuation of, and claims priority to and the benefit of, International Application No. PCT/US2018/030367, which was filed on May 1, 2018, which claims priority to and the benefit of Swiss Patent Application No. CH00590/17, which was filed on May 3, 2017, the entire contents of each of which are incorporated herein by reference.

FIELD

The present disclosure relates to a separating device for severing at least one strap, in particular a plastic strap, the separating device having a blade with an edge for severing the at least one strap, and it being possible for the separating device to be connected to a strap end connecting device, the strap end connecting device having an assembly which has a heating element. In addition, the invention relates to a strap end connecting device having a separating device of this type, and to a strapping system, having a strap end connecting device of this type.

BACKGROUND

The strap end connecting device of the generic type is what is known as an end sealer (also called a strap end connector), as is used in certain types of strapping systems. Here, the strap end connector is provided in a strapping system as a fastening head, by way of which two straps are severed one after another directly in one working step, and subsequently in each case one end of the first and of the second strap can be connected to one another in a further working step of the fastening head. Two fastenings which belong to two different strappings are typically formed at the same time and in parallel on both sides of the fastening head. In the case of packaged goods which are conveyed through a portal of a strapping system, connections of this type serve at the same time for strapping of a front first packaged good and for strapping of a following second packaged good which is situated behind it. In the case of the front packaged good, it is a strap fastening which is situated on the rear side of the first packaged good in the conveying direction. In the case of the following second packaged good, it is a strap fastening which is situated on the front side of the second packaged good, once again as viewed in the conveying direction. After its front fastening is produced, the second packaged good is usually transported into the strap with said second fastening. The conveying movement of the packaged good then brings it about that the strap bears against the front side of the second packaged good and against the two sides of the packaged good. Two assemblies of the strap end connecting device, of which in each case one is arranged at this time on in each case one side of the respective packaged good, are then moved toward one another behind the packaged good. Here, each of said two assemblies of the strap end connector guides one side of the strapping to be formed and moves it behind the packaged good. Here, one of said two assemblies comprises a separating device for severing the two strapping sides from their strap supply. Moreover, one of the two assemblies comprises a pressing unit, by way of which the two strap ends are brought into contact against one another. One of the two assemblies comprises a heating device, by means of which heat is introduced locally into the two strap ends which lie above one another, as a result of which the two strap ends are heated to such an extent that the plastic of the two strap ends melts locally, flows into one another, is welded to one another and, as a result, the associated strap ends are connected to one another after cooling.

A strapping system of this type is previously known from EP 225 665 A1, in the case of which the heating device is configured as a hot welding device. In the case of said device, heating elements are heated by way of electric current, which heating elements are in each case brought into contact against one of the two strap ends which lie above one another. Moreover, the strapping system which is disclosed therein and has been offered for a long time by the company Endra B.V., NL-5349 AL Oss has a strap end connector, the hot welding device of which is provided with a heating bead which projects in the direction of the other assembly. Together with the heating elements, the heating bead is heated electrically and serves to sever the two straps. This solution has the disadvantage, however, that comprehensive insulation measures have to be taken, in order that the entire strapping system does not carry current during the contact of the heating bead with the second assembly. Moreover, the heating bead becomes clogged over time with melted plastic deposits which have to be removed regularly, in order that the functional reliability is not impaired.

Moreover, a strap end connector is previously known from DE 102 25 751 C5, in the case of which strap end connector the heating device is configured as a vibration welding device which is assigned to one of the two assemblies. In the case of said vibration welding device, the heat which is required for melting of the plastic is introduced into the strap ends by means of welding elements which are pressed against the two strap ends and are moved to and fro in an alternating and vibrating manner. The other assembly is provided with a mechanical edge or blade which is moved into the two straps in order to sever the latter. In this solution, therefore, the plastic straps are severed by way of a mechanical cutting operation. This solution has the disadvantage that it is not fully functionally reliable and, above all, relatively thick straps can cause difficulties in terms of being severed reliably. In addition, cutting of the strap and welding of the strap ends cannot take place in the same cycle without an additional lift.

SUMMARY

Various embodiments of the present disclosure provide an improvement in the case of strap end connectors, by way of which improvement functionally reliable severing becomes possible even in the case of different strap thicknesses with maintenance of the severing means which is as low as possible.

This improvement is achieved by way of a separating device of the type mentioned at the outset by virtue of the fact that the blade can be connected or is connected to the assembly which has the heating element. In addition, this improvement is achieved by way of a strap end connecting device and by way of a strapping system.

By virtue of the fact that the at least one strap is cut and is not severed by way of heating, no deposits are produced on the heating element and odor production is therefore also at least reduced. A strap end connecting device (called a strap end connector for short) having a separating device according to the present disclosure can be operated without cleaning intervals or with relatively long cleaning intervals. The risk of contamination of the cutting edge is reduced. Functionally reliable severing is possible even in the case of different strap thicknesses with maintenance of the blade which is nevertheless as low as possible. Wear of the heating element is reduced, since a highly loaded separating edge can in certain embodiments be dispensed with on the heating element itself. The edge of the blade can be resharpened, in particular by stropping, with the result that long service lives of the blade can be achieved. The sharpening of the blade can take place in a state, in which it is dismantled from the heating element. Cutting of the strap and welding of the strap ends can take place in the same cycle without an additional lift.

The separating device in certain embodiments has a carrier, on which the blade is arranged, the carrier being provided for attaching or arranging on that assembly of the strap end connecting device which has the heating element. The blade can be arranged in the vicinity of the heating element by means of the carrier; vicinity can be understood to mean a spacing, in the case of which, by means of the heating element, the blade experiences or can experience a temperature increase on account of the heating element despite a spacing between the heating element and the blade. A spacing between the heating element and the blade is in certain embodiments adjustable, for example by way of suitable structural measures. As a result, a temperature of the blade can be influenced in a targeted manner. The carrier can have positioning aids for arranging on the assembly which has the heating element. The carrier can be capable of being screwed to the assembly which has the heating element, in particular in a releasable manner. There should preferably not be direct physical contact between the blade and the heating element.

In one embodiment, the blade can be arranged in an electrically insulated manner on the assembly which has the heating element. This avoids a situation where an electric current can flow from the heating element to the blade and can electrify further components of the strap end connecting device.

The edge of the blade and a movement direction of the blade in certain embodiments enclose an angle of less than 90°, preferably an angle of 82°. This angle makes an optimized cutting process possible. The straps preferably run perpendicularly with respect to the movement direction of the blade. The blade then advantageously has an edge with in certain embodiments a linearly running cutting edge which is arranged at an angle of preferably at least 5°, at most preferably 8°, with respect to the straps to be severed. In order to ensure high stability of the blade and a satisfactory cutting process, an edge angle of the blade should have a value between 25 and 35°, and should preferably have a value of 30°.

In addition, the improvement is achieved by way of a strap end connecting device for a strapping system. The strap end connecting device in certain embodiments has a first assembly for heating, in particular welding, at least two strap ends to be connected to one another of a strap, and a second assembly for placing, in particular pressing, the strap ends which are to be connected to one another onto one another and/or onto the first assembly. The first assembly for heating, in particular welding, at least two strap ends to be connected to one another of a strap can be an assembly which has the heating element. Welding can take place, for example, by means of a hot welding process or a rotary friction or vibration welding process.

The first assembly can have a heatable first fastening head which is coupled to or in certain embodiments provided with a heating element. The heating element (for example, an electric heating element) can be integrated into the first fastening head. The second assembly can have a second fastening head which is decoupled from the heating element or is in certain embodiments not provided with a heating element. During operation of the strap end connecting device, the temperature of the first fastening head is in certain embodiments higher than the temperature of the second fastening head on account of the heating element. The heating element can be a constituent part of a welding unit of the first assembly. The heating element can also, however, be a heating element which is configured separately from the welding unit for heating the blade by way of heat radiation. In one embodiment, in which the heating element is a constituent part of the welding unit of the first assembly, the temperature increase of the blade in comparison with the ambient temperature in the region of the strapping apparatus can also take place by way of heat radiation of the heating element.

The blade can in certain embodiments be fed in together with the welding unit in the direction of a pressing unit of the second assembly. The blade can be heated particularly effectively by way of heat radiation and is nevertheless itself not electrified by the heating element (preferably being electrically heatable) and the blade being arranged at a spacing from the heating element. The blade can be heated to a higher operating temperature in comparison with an ambient temperature by the heating element, in particular electrically generated heat radiation.

The blade is insulated electrically from an electrically heated heating element by way of an insulation means. The blade is in certain embodiments arranged on a carrier which is connected to the insulation means. A spacing is provided between the blade and the heating element. Here, the spacing of the blade from the heating element is preferably 0.5 mm, as a result of which a sufficient electric insulation of the blade is ensured. The present disclosure is not restricted to said dimension, however. A multiplicity of other spacing dimensions between the blade and the heating element can also be provided in conjunction with said embodiment or other embodiments of the present disclosure.

In addition, the improvement is achieved by way of a strapping system. A first strap and a second strap can in certain embodiments be severed directly one after another in one working step by means of the separating device of the strap end connecting device, and in each case one strap end of the first strap and one strap end of the second strap are connected to one another in a further working step by means of the strap end connecting device. As a result, two fastenings which can belong to two different strappings can be produced at the same time and in parallel.

Further refinements of the present disclosure result from the claims, the description and the drawing.

BRIEF DESCRIPTION OF THE DRAWINGS

The present disclosure will be described in greater detail using exemplary embodiments which are shown purely diagrammatically in the figures, in which.

DETAILED DESCRIPTION

Figure 1:
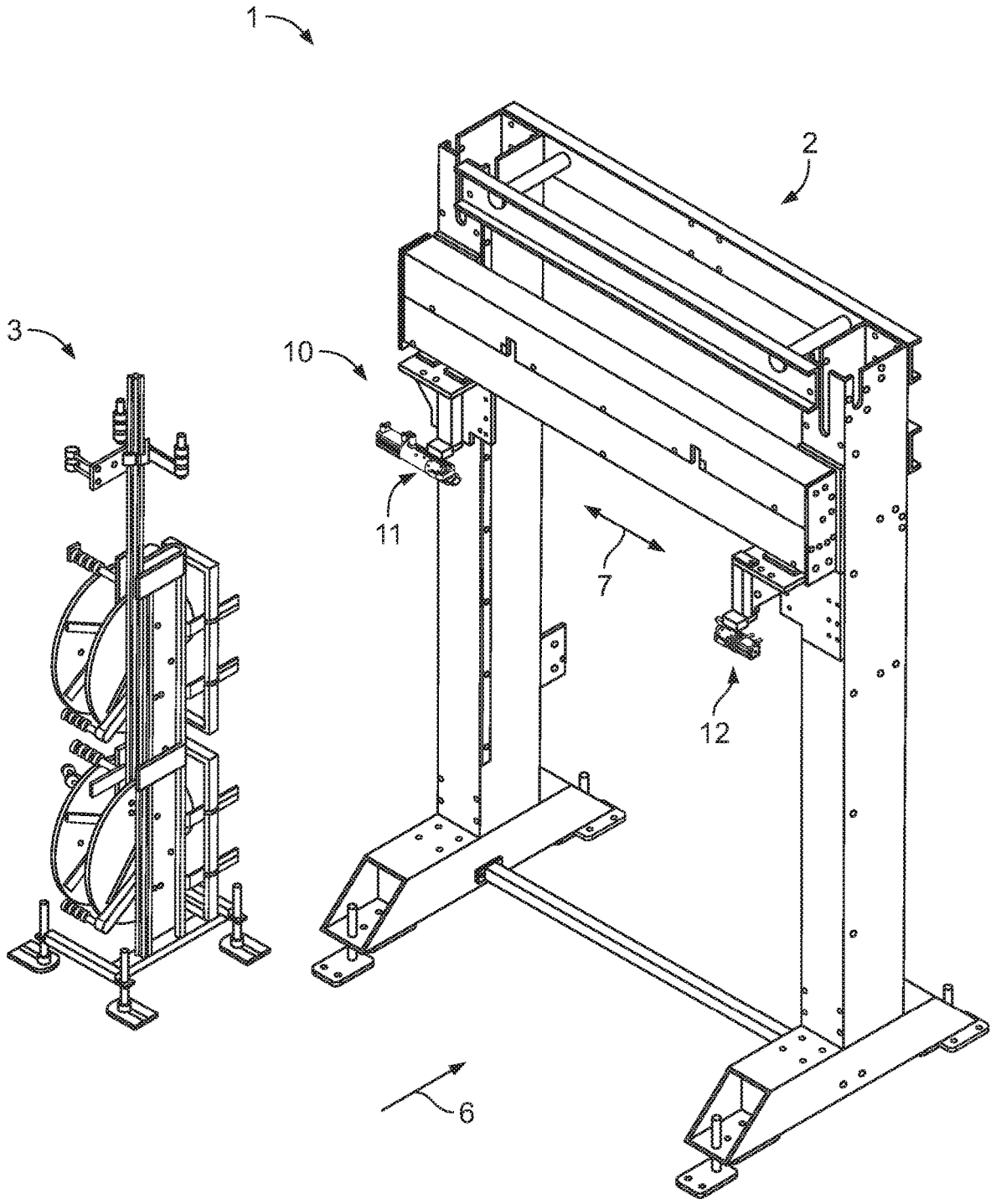
FIG. 1 shows a perspective illustration of a strapping system according to the present disclosure which is provided with a strap end connecting device according to the present disclosure, having a separating device according to the present disclosure, the strap end connecting device being shown in a moved-apart state.
Figure 2:
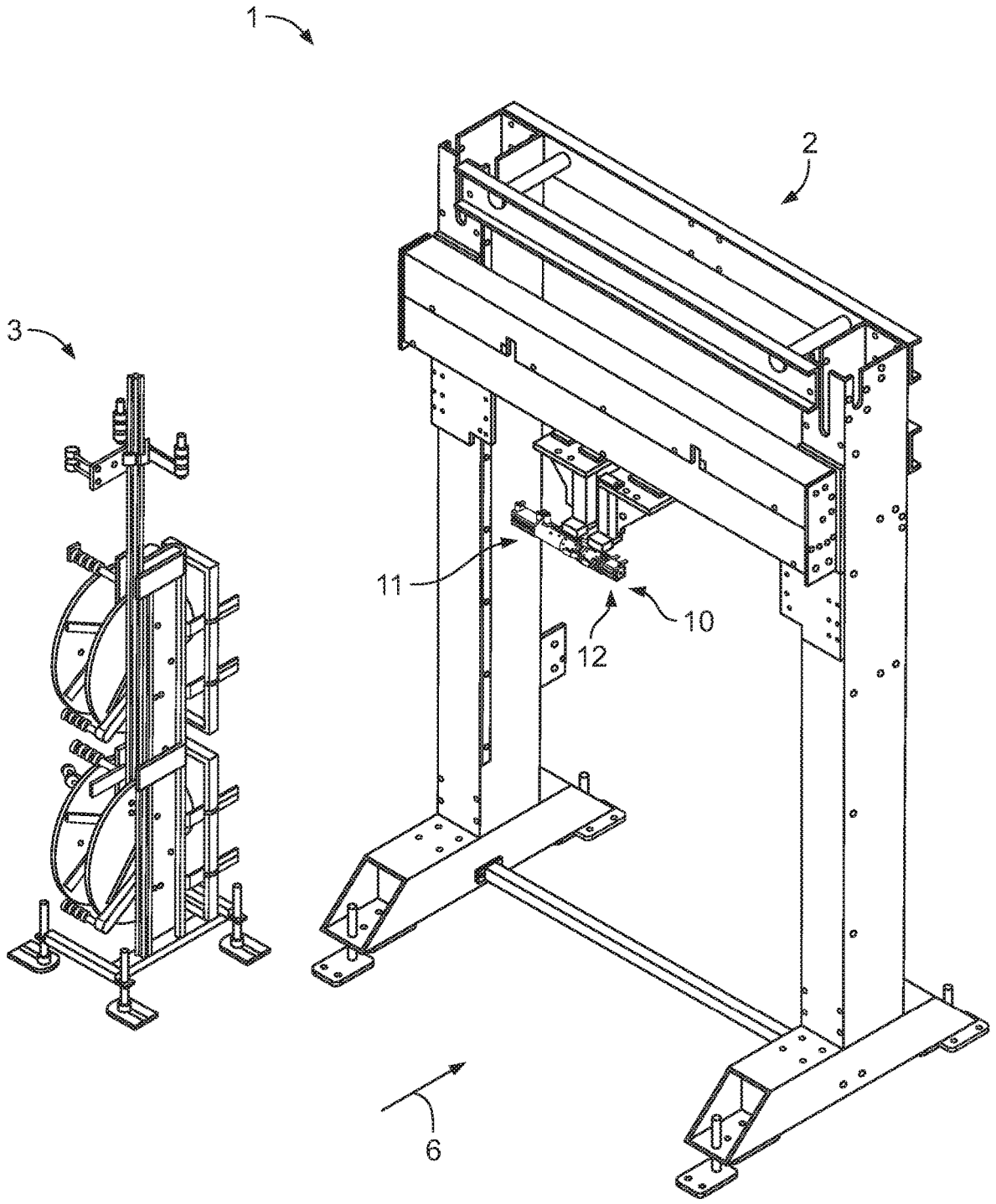
FIG. 2 shows a perspective illustration of the strapping system from FIG. 1, the strap end connecting device being shown in a moved-together state.
Figure 3:
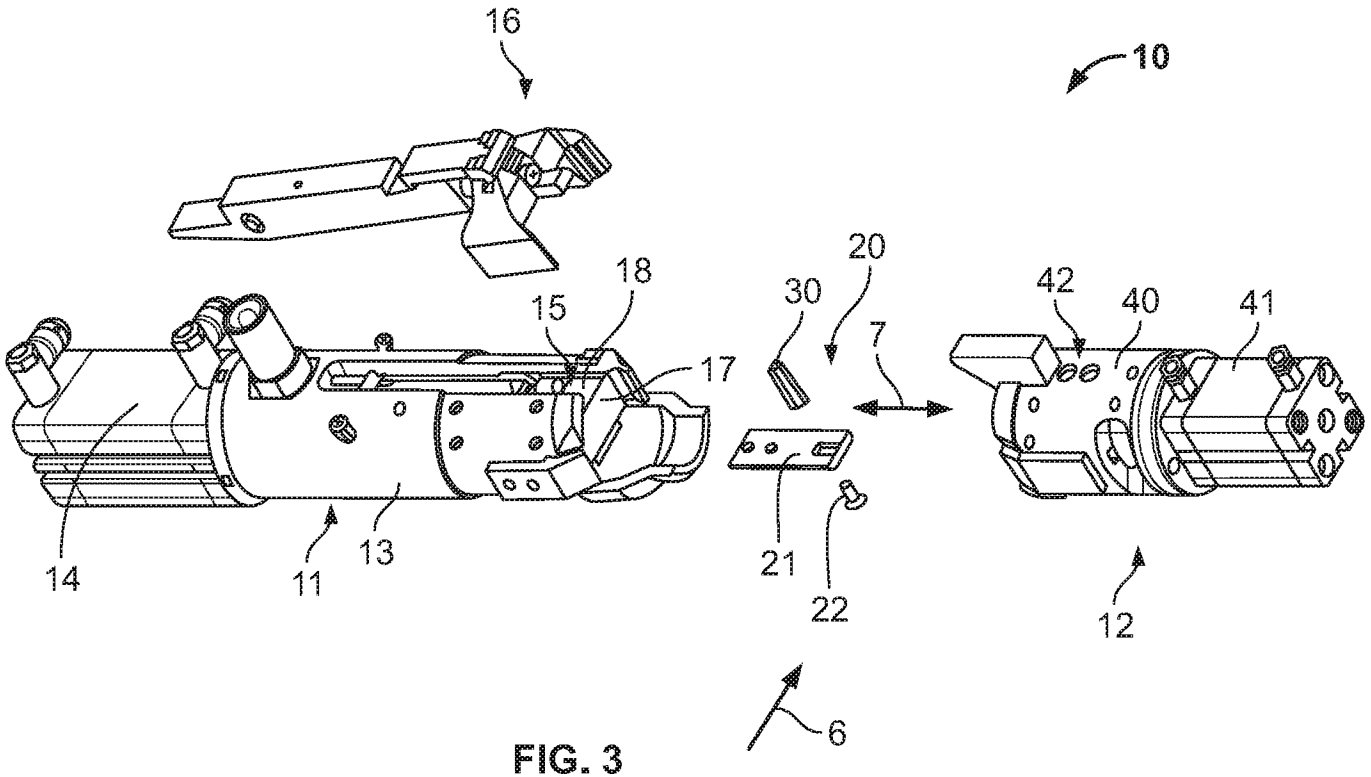
FIG. 3 shows an exploded illustration of the strap end connecting device from FIG. 1; having a welding unit, a strap clamp and a pressing unit.
Figure 4:
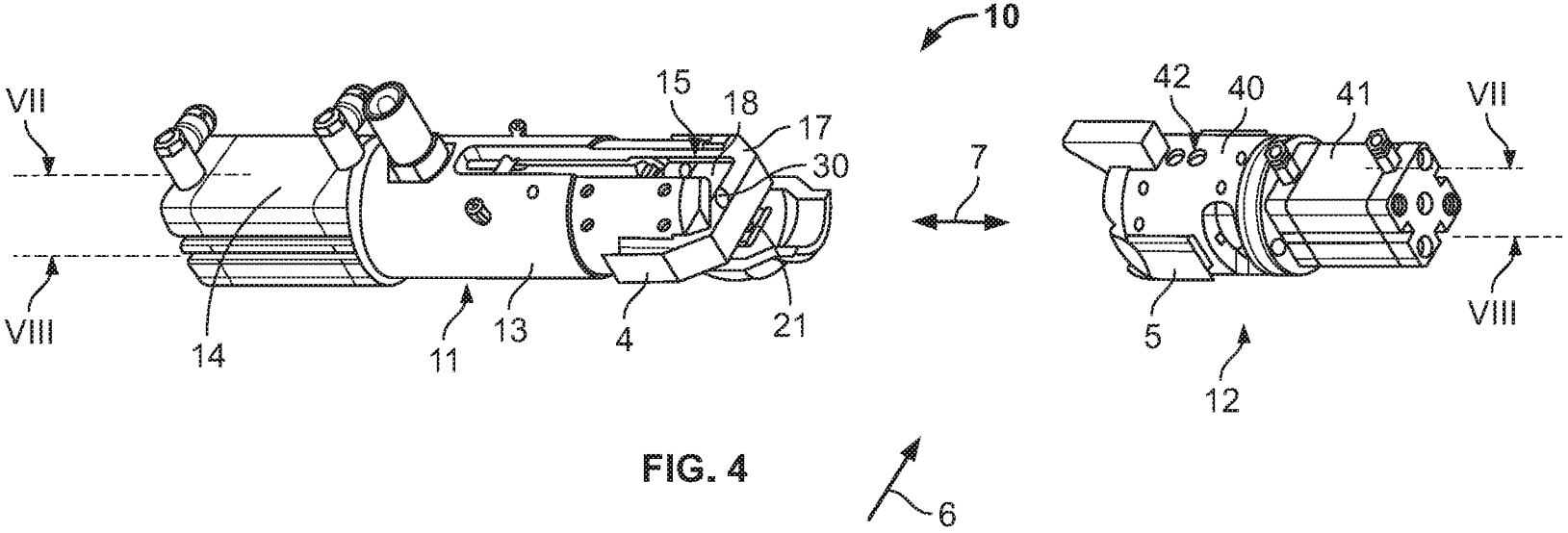
FIG. 4 shows a perspective illustration of the welding unit and the pressing unit from FIG. 1, against which in each case one section of an associated strap bears.
Figure 5:
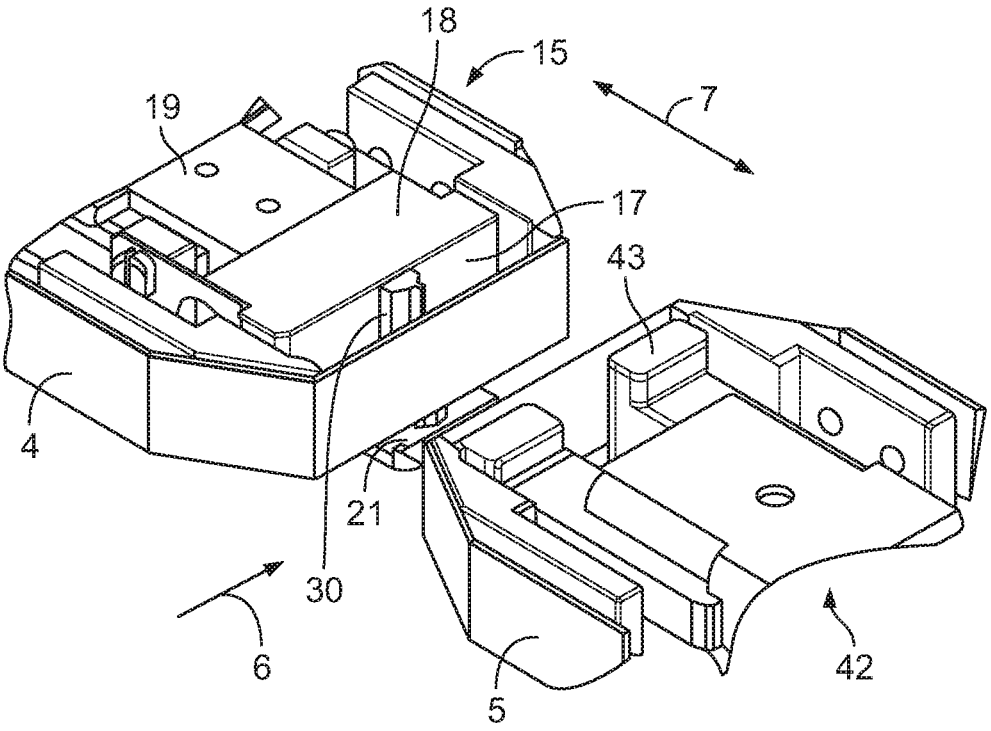
FIG. 5 shows a perspective detailed view of the welding unit and the pressing unit from FIG. 1, against which in each case one section of an associated strap bears.
Figure 6:
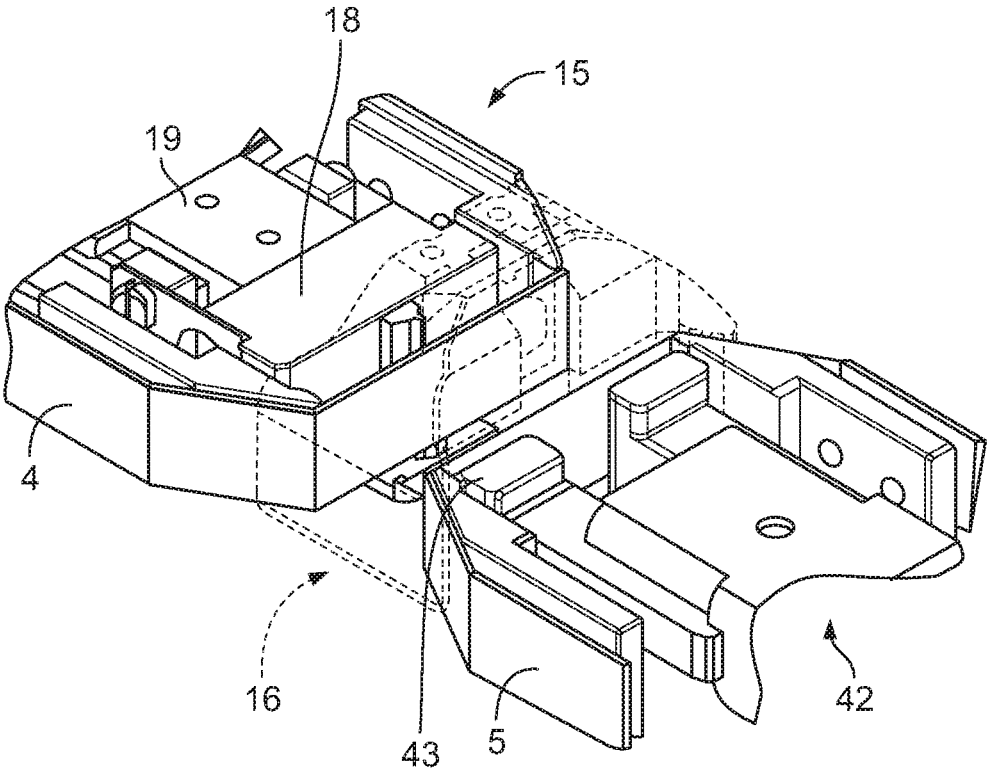
FIG. 6 shows a perspective detailed view of the strap end connecting device from FIG. 1; in each case one section of an associated strap bears against the welding unit and against the pressing unit, held by way of the strap clamp.
Figure 7:
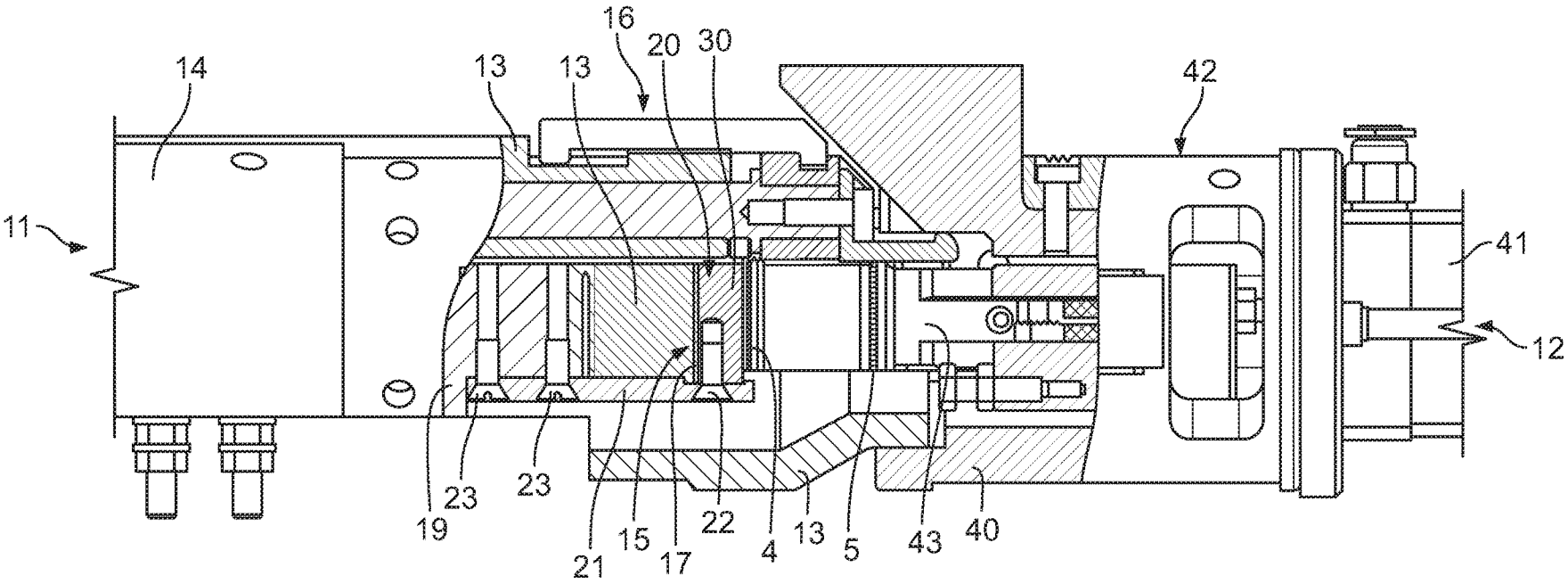
FIG. 7 shows a section along the line VII-VII in FIG. 4, the strap end connecting device being shown in a moved-together state.
Figure 8:
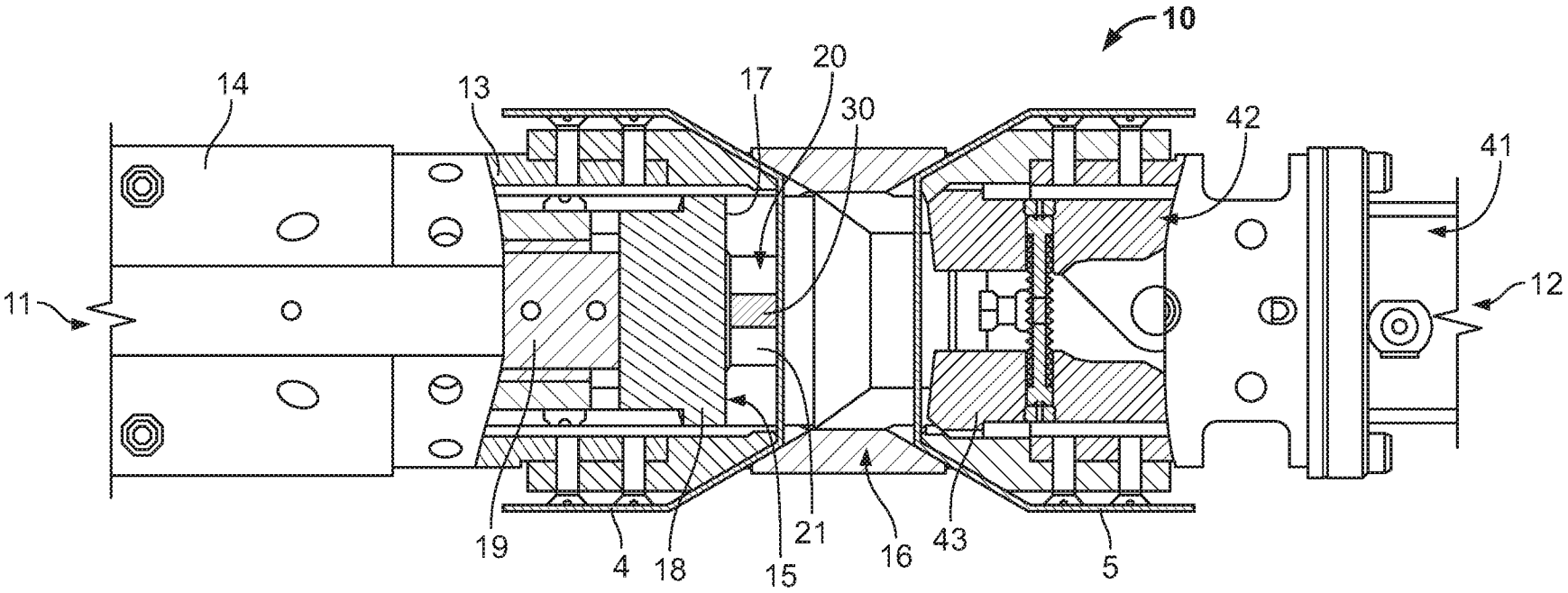
FIG. 8 shows a section along the line VIII-VIII in FIG. 4, the strap end connecting device being shown in a moved-together state.

FIGS. 1 and 2 show a strapping system 1 which has a gantry 2 and a supply device 3 for storing and for providing two straps 4, 5 made from plastic for producing self-contained ring-like strapping straps for packaged goods. The gantry 2 comprises a strap end connecting device 10 with a first fastening head 11 and a second fastening head 12. The fastening heads 11, 12 serve for an advancing movement of the two straps 4, 5 toward one another, for severing the two straps 4, 5, and for welding a first strap end 4*a* of the first strap 4 to a first strap end 5*a* of the second strap 5, and for welding a second strap end 4*b* of the first strap 4 to a second strap end 5*b* of the second strap 5.

Two strap fastenings which belong to two different strappings are formed at the same time and in parallel by way of said welding of the strap ends 4*a*, 4*b*, 5*a*, 5*b*. In the case of packaged goods which are conveyed through the gantry 2 of the strapping system 1, a strapping of a front packaged good and a strapping of a subsequent, rear packaged good are produced at the same time. In the case of the front packaged good, it is a strap fastening which is situated on the rear side of the first packaged good in a conveying direction 6. In the case of the following second packaged good, it is a strap fastening which is situated on the front side of the second packaged good, once again as viewed in the conveying direction 6. After its front fastening is produced, the rear packaged good is usually transported into the strap with said second fastening. The conveying movement of the packaged good in the conveying direction 6 then brings it about that the strap bears against the front side of the second packaged good and against the two sides of the packaged good. In the above-described way, therefore, any desired number of packaged goods can be conveyed through the gantry 2 and can be provided with a strapping.

FIGS. 3 to 8 show the strap end connecting device 10. The strap end connecting device 10 has the first fastening head 11 and the second fastening head 12.

The first fastening head 11 has a housing 13, a pneumatic cylinder 14, and a welding unit 15. A strap clamp 16 is fastened pivotably to the first fastening head 11 in such a way that the straps 4, 5 can be fixed in the strap end connecting device 10 by means of the strap clamp 16. The welding unit 15 comprises an electrically heatable heating element 17 as a first assembly for heating, in particular welding, the straps 4, 5 in the region of the strap ends 4*a*, 4*b*, 5*a*, 5*b*. The heating element 17 is configured as an electrically heatable heating plate. The heating element 17 is fastened on an insulation block 18 made from an electrically non-conductive material. By means of the pneumatic cylinder 14, the insulation block 18 with the heating element 17 which is fastened thereon can be moved to and fro transversely with respect to the conveying direction 6 and in the direction of the second fastening head 12 in and counter to a movement direction 7 of the fastening heads 11, 12. The blade 30 moves together with the heating element 17 relative to the housing 13 and parallel to the movement direction 7.

The first fastening head 11 has a separating device 20. The separating device 20 has a carrier 21 and a blade 30. The blade 30 is fastened to the carrier 21, in the present case is screwed by means of a bolt 22. On a side of the insulation block 18 which faces away from the blade 30, the carrier 21 is fastened to a further electrically insulated component 19 of the fastening head 11, in the present case is screwed by means of two bolts 23. In addition, the carrier 21 bears against the insulation block 18. On account of the fastening of the carrier 21 to the insulated component 19, the carrier is insulated electrically from the current-conducting heating element, with the result that the blade 30 cannot come into contact with the electric current via the carrier 21. The blade 30 is arranged at a spacing from the heating element 17. As a result, the blade 30 is additionally insulated by means of an air gap from the current-conducting heating element 17. The smallest spacing between the blade 30 and the heating element 17 is preferably 0.5 mm or more.

The second fastening head 12 has a housing 40, a pneumatic cylinder 41, and a pressing unit 42. By means of the pneumatic cylinder 41, the pressing unit 42 can be moved forward and backward transversely with respect to the conveying direction 6 and in the direction of the first fastening head 11 in and counter to the movement direction 7 of the fastening heads 11, 12. The pressing unit 42 has a pusher 43 for pressing the strap ends 4*a*, 4*b*, 5*a*, 5*b* which are heated by the heating element 17. As a result, the strap ends 4*a*, 4*b*, 5*a*, 5*b* can be welded to one another. The pusher 43 is shaped in a U-shaped manner in such a way that the blade 30 can cut the second strap 5 which bears against the pusher 43, without the blade 30 colliding with the pusher 43.

Figure 9:
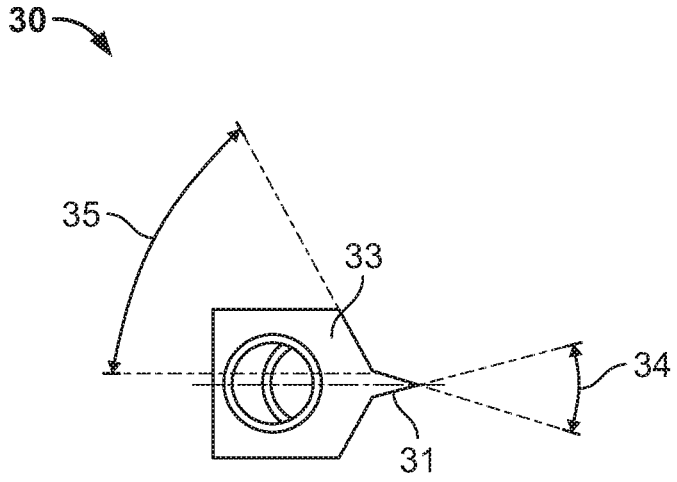
FIG. 9 shows a view obliquely from below of a blade of the separating device.
Figure 10:
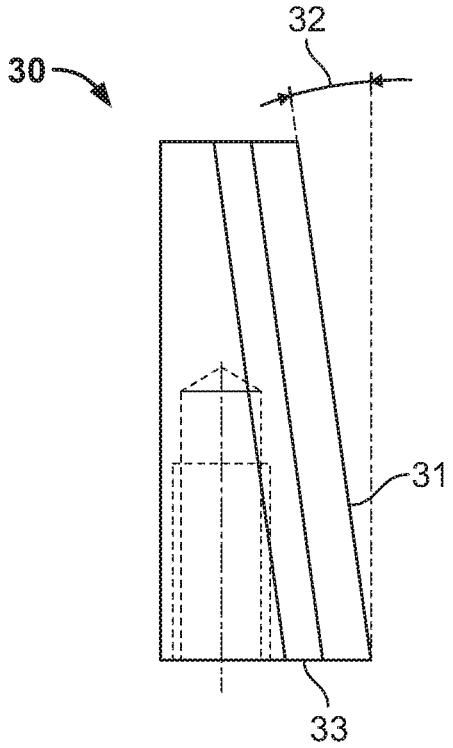
FIG. 10 shows a side view of the blade from FIG. 9.
Figure 11:
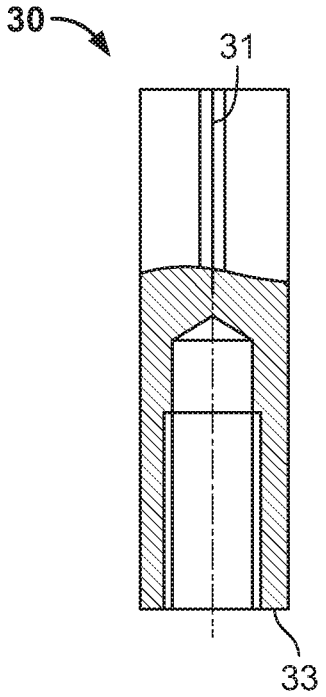
FIG. 11 shows a partly cut-away front view of the blade from FIG. 9.

FIGS. 9 to 11 show one embodiment of the blade 30. The blade 30 has an edge 31 with a linearly running cutting edge which is arranged at an angle 32 of preferably at least 5°, very preferably 8°, with respect to the straps 4, 5 which are to be severed. An angle between the movement direction 7 of the fastening heads 11, 12 and the edge 31 is preferably at most 85°, very preferably 82°. A supporting face 33 of the blade 30 runs parallel to the movement direction 7 of the fastening heads 11, 12. A blind bore which is provided with an internal thread runs in the blade 30 perpendicularly with respect to the supporting face 33. The bolt 22 for fastening the blade 30 to the carrier 21 can be screwed into said internal thread.

An edge angle 34 of the blade 30 is preferably 30°. The edge angle 34 can also differ considerably from said value, however. A region of the blade 30 which points away from the cutting edge has a run-out angle 35 which is 60° in the present case, but the run-out angle 35 can also have other values. The run-out angle 35 is enclosed between the movement direction 7 and that region of the blade 30 which points away from the cutting edge. The run-out angle 35 avoids contact between the straps 4, 5 to be severed and that region of the blade 30 which is arranged behind the cutting edge. The blade 30 is in certain embodiments made from a temperable steel material.

Figure 12:
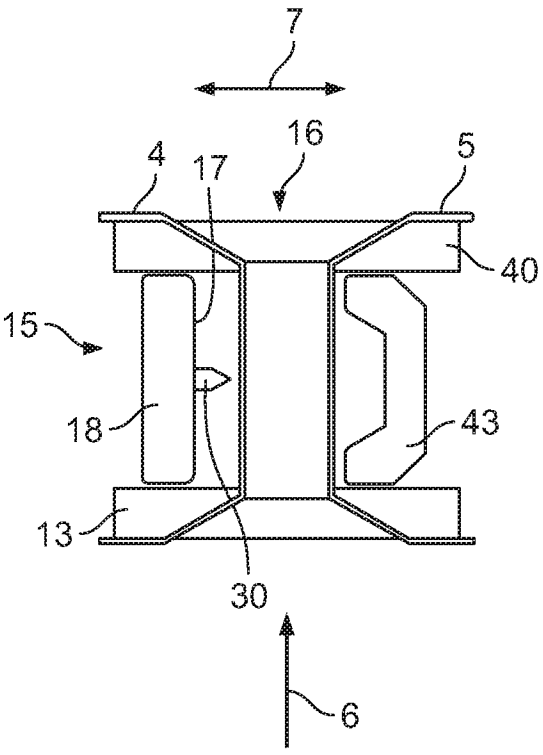
FIG. 12 shows a diagrammatic illustration of the strap end connecting device in an operating position, in which a heating element and a blade of a heatable fastening head are in a starting position.

FIG. 12 shows a diagrammatic illustration of the strap end connecting device 10 in an operating position which corresponds to a first method step and in which the first fastening head 11 and the second fastening head 12 are moved together completely. The strap clamp 6 fixes the straps 4, 5. The first strap 4 is clamped in fixedly between the housing 13 of the first fastening head 11 and the strap clamp 16. The second strap 5 is clamped in fixedly between the housing 40 of the second fastening head 12 and the strap clamp 16. The heating element 17 and the blade 30 which is heated by way of heat radiation are in a starting position. The edge 31 of the blade 30 is spaced apart from the two straps 4, 5.

Figure 13:
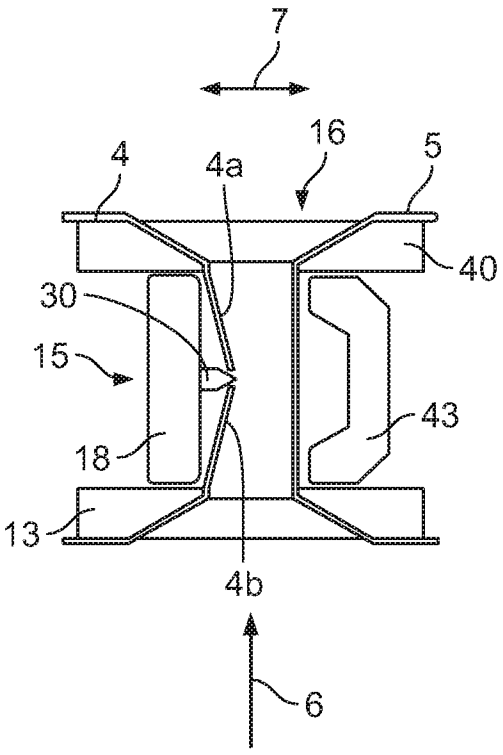
FIG. 13 shows an illustration which corresponds to FIG. 12 and in which the heating element and the blade are shown in a partially extended operating position, in which the blade severs a first strap.

FIG. 13 shows the heating element 17 and the blade 30 in a partially extended operating position which corresponds to a following method step and in which the blade 30 severs the first strap 4. The first strap end 4*a* and the second strap end 4*b* of the first strap 4 are produced as a result. By way of further extension of the blade 30 in the movement direction 7, the two strap ends 4*a*, 4*b* of the first strap 4 are oriented parallel to the movement direction 7 and spaced apart from one another, and are placed from the inside onto the strap clamp 16.

Figure 14:
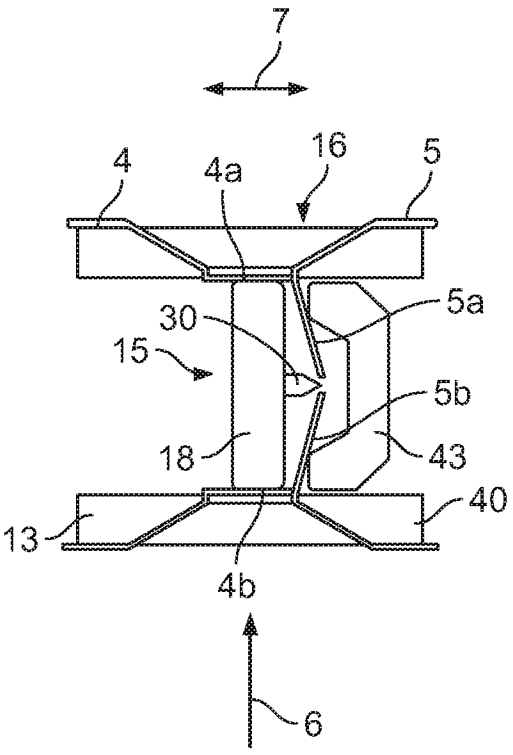
FIG. 14 shows an illustration which corresponds to FIG. 12 and in which the heating element and the blade are shown in a greatly extended operating position, in which two strap ends of the first strap are turned over and the blade severs a second strap.

FIG. 14 shows the heating element 17 and the blade 30 in a further following method step and a correspondingly largely extended operating position, in which the strap ends 4*a*, 4*b* of the first strap 4 are turned over completely and heated by means of the heating element 17, and the blade 30 severs the second strap 5. The first strap end 5*a* and the second strap end 5*b* of the second strap 5 are produced as a result.

In a further method step which is not shown in the figures, the first strap end 5*a* and the second strap end 5*b* of the second strap 5 are oriented parallel to the movement direction 7, but in the opposite direction with respect to the strap ends 4*a*, 4*b* of the first strap 4 and spaced apart from one another, and are welded in each case to the associated strap ends 4*a*, 4*b*. To this end, the pusher 43 of the pressing unit 42 moves in the direction of the first fastening head 11 relative to the housing 40 of the second fastening head 12, and places the strap ends 5*a*, 5*b* accordingly onto the associated strap ends 4*a*, 4*b* and presses against one another the strap ends 4*a*, 5*a* which bear against one another and the strap ends 4*b*, 5*b* which bear against one another, as a result of which they are welded in each case to one another.

| List of Designations | |
|---|---|
| 1 | Strapping system |
| 2 | Gantry |
| 3 | Supply device |
| 4 | First strap |
| 4a | First strap end |
| 4b | Second strap end |
| 5 | Second strap |
| 5a | First strap end |
| 5b | Second strap end |
| 6 | Conveying direction |
| 7 | Movement direction |
| 10 | Strap end connecting device |
| 11 | First fastening head |
| 12 | Second fastening head |
| 13 | Housing |
| 14 | Pneumatic cylinder |
| 15 | Welding unit |
| 16 | Strap clamp |
| 17 | Heating element |
| 18 | Insulation block |
| 19 | Component |
| 20 | Separating device |
| 21 | Carrier |
| 22 | Bolt |
| 23 | Bolt |
| 30 | Blade |
| 31 | Edge |
| 32 | Angle |
| 33 | Supporting face |
| 34 | Edge angle |
| 35 | Run-out angle |
| 40 | Housing |
| 41 | Pneumatic cylinder |
| 42 | Pressing unit |
| 43 | Pusher |

The invention claimed is:

1. A strapping machine comprising:

a frame; and a strap-end-connecting device supported by the frame and comprising:

a first fastening head movable relative to the frame in a movement direction and comprising:

a first housing;

a welding unit at least partially within the first housing, the welding unit comprising a first insulation block and an electrically heatable heating element, wherein the heating element is mounted to the first insulation block and includes an electrically conductive material;

a separating device comprising a carrier movable with the welding unit and a blade mounted to the carrier such that the blade does not directly contact the heating element, wherein the carrier and the blade are electrically insulated from the heating element; and a first actuator operably connected to the welding unit to move the welding unit and the separating device relative to the first housing in the movement direction toward a second fastening head; and the second fastening head movable relative to the frame in the movement direction and comprising:

a second housing;

a pressing unit; and a second actuator operably connected to the pressing unit to move the pressing unit relative to the second housing in the movement direction toward the first fastening head; and a strap clamp movable transverse to the movement direction to clamp a first strap against the first housing and to clamp a second strap against the second housing.

2. The strapping machine of claim 1, wherein the first actuator comprises a pneumatic cylinder.

3. The strapping machine of claim 1, wherein the second actuator comprises a pneumatic cylinder.

4. The strapping machine of claim 1, wherein the blade is positioned relative to the heating element so when the heating element is heated the heating element heats the blade via radiation.

5. The strapping machine of claim 1, wherein the first insulation block has first and second ends spaced-apart in the movement direction, wherein the heating element extends across the second end of the first insulation block in a direction transverse to the movement direction.

6. The strapping machine of claim 1, wherein the carrier is mounted to an electrically insulated component of the welding device.

7. The strapping machine of claim 6, wherein the electrically insulated component of the welding device comprises a component other than the first insulation block.

8. The strapping machine of claim 7, wherein the electrically insulated component comprises a second insulation block on a side of the first insulation block opposite the heating element.

9. The strapping machine of claim 1, wherein the strap clamp is pivotably mounted to the first fastening head.

* * * * *